US009868556B2

(12) United States Patent
Le Rigoleur

(10) Patent No.: US 9,868,556 B2
(45) Date of Patent: Jan. 16, 2018

(54) HAND-HELD HANDLE DISPENSER

(71) Applicant: NEOPOST TECHNOLOGIES, Bagneux (FR)

(72) Inventor: Yann Le Rigoleur, Antony (FR)

(73) Assignee: Neopost Technologies, Bagneux (FR)

( * ) Notice: Subject to any disclaimer, the term of this patent is extended or adjusted under 35 U.S.C. 154(b) by 230 days.

(21) Appl. No.: 14/606,572

(22) Filed: Jan. 27, 2015

(65) Prior Publication Data

US 2015/0217890 A1 Aug. 6, 2015

(30) Foreign Application Priority Data

Jan. 31, 2014 (EP) ..... 14290016

(51) Int. Cl.

| | |
|---|---|
| ***B29C 37/00*** | (2006.01) |
| ***B44C 7/00*** | (2006.01) |
| ***B65B 29/04*** | (2006.01) |
| ***B65B 61/00*** | (2006.01) |
| ***B65B 51/06*** | (2006.01) |
| ***B65H 35/00*** | (2006.01) |
| ***B65H 37/04*** | (2006.01) |
| ***B65D 5/46*** | (2006.01) |

(52) U.S. Cl.

CPC ..... *B65B 51/06* (2013.01); *B65B 51/067* (2013.01); *B65D 5/46016* (2013.01); *B65H 35/002* (2013.01); *B65H 35/004* (2013.01); *B65H 35/008* (2013.01); *B65H 37/04* (2013.01); *Y10T 156/10* (2015.01); *Y10T 156/1062* (2015.01); *Y10T 156/1348* (2015.01)

(58) Field of Classification Search

CPC ..... B65H 35/004; B65H 35/002; B65H 35/0013; B65H 35/0026; B65H 35/0033; B65H 37/005; B65H 2701/32

See application file for complete search history.

(56) References Cited

U.S. PATENT DOCUMENTS

| | | | | |
|---|---|---|---|---|
| 4,028,865 A * | 6/1977 | Loveland | B65B 51/067 53/76 |
| 4,869,769 A * | 9/1989 | DiRusso, Jr. | B31B 1/90 156/269 |
| 5,079,900 A | 1/1992 | Pinckney et al. | |
| 5,081,817 A * | 1/1992 | Nesbitt | B65B 61/14 53/134.1 |

(Continued)

FOREIGN PATENT DOCUMENTS

| | | | |
|---|---|---|---|
| WO | WO 8803897 A1 * | 6/1988 | B65B 51/067 |

OTHER PUBLICATIONS

European Search Report of EP 14 29 0016 dated Jun. 20, 2014.

*Primary Examiner* — Alex Efta

(74) *Attorney, Agent, or Firm* — Seed IP Law Group LLP

(57) ABSTRACT

A hand-held handle dispenser comprising: a main frame (12) having a handle (14), an adhesive tape roll (16) provided at a rear side of the main frame for delivering an adhesive tape, an application roller (18) provided at the front side of the main frame for applying the adhesive tape on a parcel and a cutting blade (20) for cutting the adhesive tape, a cartridge (22) for storing at least one insert strip (24) and transport and affixing means (26, 28) for conveying said at least one insert strip from the cartridge to the application roller and affixing it against the adhesive tape to form a handle.

20 Claims, 6 Drawing Sheets

(56) References Cited

U.S. PATENT DOCUMENTS

| | | | | |
|---|---|---|---|---|
| 5,145,108 | A * | 9/1992 | Pinckney | B65B 61/14 229/117.23 |
| 6,159,328 | A * | 12/2000 | Gaikoski | B65B 51/06 156/269 |
| 6,234,230 | B1 * | 5/2001 | Petitjean | B65B 61/14 156/302 |
| 2008/0135179 | A1 | 6/2008 | Bedard | |
| 2009/0084504 | A1 * | 4/2009 | Lam | B65B 51/067 156/538 |
| 2013/0048218 | A1 * | 2/2013 | Lam | B65H 35/0013 156/510 |

* cited by examiner

HAND-HELD HANDLE DISPENSER

FIELD OF THE INVENTION

The present invention relates to the sealing of packages, cartons or parcels, and more particularly to a hand-held handle dispenser for forming a handle for carrying these packages.

PRIOR ART

Current hand-held adhesive tape dispensers commonly used for parcel wrapping and closure, do not provide the ability to the user to add a handle to the parcel being closed. To add a handle to the parcel, a user has to place an "external" pre-manufactured handle, or some other "external" ad-hoc handle.

Such a solution requires different pre-manufactured handle models to fit with different parcel sizes. This creates logistics and storage difficulties, in addition to the second separate step in affixing the pre-manufactured handle following on the wrapping and closing of the parcel.

Another solution is to use a specific box with prepositioned holes made as handles. Such a solution suffers drawbacks. Indeed, customers often prefer to avoid holes in the package to secure the integrity of the content and so that the interior of the parcel cannot be seen. Moreover, the creation of these holes is an additional cost and may be the cause of a deterioration of the parcel.

OBJECT AND DEFINITION OF THE INVENTION

The object of the invention consists therefore in overcoming the above drawbacks. Another object is to give the user the ability to make handles of various lengths depending on the parcel size and shape.

These objects are achieved by providing a handle distributor incorporated in a hand-held adhesive tape dispenser to constitute a hand-held handle dispenser for affixing both the tapes and the handles.

By locating the handle distributor on the hand-held adhesive tape dispenser, there is no need to search for and choose an "external" handle from a selection of "external" pre-manufactured handles of different sizes. The handle is added to a fully closed parcel without the need for holes/openings in the parcel and it reduces significantly the cost of using such external pre-manufactured handle. Moreover, the user can place the handle(s) where it is most appropriate with regards to the parcel and its contents.

According to a feature of the invention, the cartridge is arranged to store pre-cut insert strips and in that said transport and affixing means comprises transport/selection rollers for conveying one by one the pre-cut insert strips from the cartridge to said application roller and a trigger for controlling said transport/selection rollers and initiating the affixing of a first pre-cut insert strip.

Preferably, in order to create a long strip corresponding to a particular handle length, a second and further pre-cut insert strips are dispensed just after the first one.

According to another feature of the invention, the cartridge is arranged to store pre-cut insert strips and in that said transport and affixing means comprises a pusher button actionable by a user to slide the cartridge horizontally relative to the main frame in order to bring the uppermost pre-cut insert strip against the adhesive tape and a spring to slide back the cartridge to its rest position when the user releases the pusher button, thus separating the uppermost pre-cut insert strip from the other remaining in the cartridge.

Advantageously, a pre-cut insert strip is formed by a thin strip of paper approximately 45 mm×205 mm with a non-printed side coated by a thin film of plastic of same dimensions.

According to yet another feature of the invention, the cartridge is arranged to store an insert strip roll, and said transport and affixing means comprise a trigger acting against a spring mechanism for initiating the affixing of the insert strip and for stopping the dispensing from said insert strip roll by cutting the insert strip.

Preferably, the cutting of an insert strip of determined length is performed via a presser acting on a knife for stopping the dispensing from said insert strip roll.

In an alternative embodiment, the insert strip roll includes perforated separating lines, which are regularly spaced along the insert strip of the roll at a distance that is equal or slightly less than the distance between the blocking point for the dispensing from the insert strip roll and the point of contact of said insert strip roll with the adhesive tape.

Preferably, the cutting of an insert strip of determined length is performed via a presser blocking the dispensing of said insert strip roll.

The invention also concerns a method for dispensing a handle with the above hand-held handle dispenser comprising the following steps:

- closing the parcel with a first adhesive tape,
- affixing a second adhesive tape on the parcel to fasten a first side of the handle onto the parcel,
- dispensing at least one first insert strip,
- automatically affixing said at least one first insert strip onto the second adhesive tape by bringing said at least one first insert strip in contact with the second adhesive tape,
- stopping the affixing of said at least one first insert strip, and
- resuming the affixing of the second adhesive tape on the parcel to fasten the second side of the handle onto the parcel.

When the cartridge is arranged to store an insert strip roll, stopping the affixing of said at least one first insert strip dispensed by said insert strip roll is made by cutting said insert strip roll via a presser blocking or acting on a knife for stopping the dispensing of said insert strip roll.

Advantageously, the affixing of the second adhesive tape on the parcel is made onto a determined length of the first adhesive tape already used for closing the parcel.

BRIEF DESCRIPTION OF THE DRAWINGS

Other aspects, features and advantages of the present teachings will become clearer to those ordinary skilled in the art upon review of the following description of a specific preferred embodiment of the invention in conjunction with the accompanying drawings where.

DETAILED DESCRIPTION OF EMBODIMENTS

The hand-held handle dispenser according to the invention not only operates as a hand held adhesive tape dispenser commonly used for parcel wrapping and closure, but also provides the ability for the user to add a handle to the parcel being closed. To this end, it is proposed to create, in a standard adhesive tape, which is regularly used for closing parcels and provided by a hand held adhesive tape dispenser, a non-adhesive zone within the length of this adhesive tape by attaching on the adhesive part of the tape an insert strip provided from a handle distributor incorporated in this hand-held adhesive tape dispenser.

So, the handle is constituted of three parts:

- a first side of the handle constituted of adhesive tape for adhering upstream onto the parcel and coming from the hand held adhesive tape dispenser,
- a middle non-adhesive zone created by affixing the insert strip onto the adhesive tape, and
- a second side of the handle constituted of adhesive tape for adhering downstream onto the parcel and coming from the hand held adhesive tape dispenser. Therefore, the user can use the same hand-held tool for both affixing the tape for closing the parcel and for affixing the handle(s) in a seamless operation.

Figure 1:
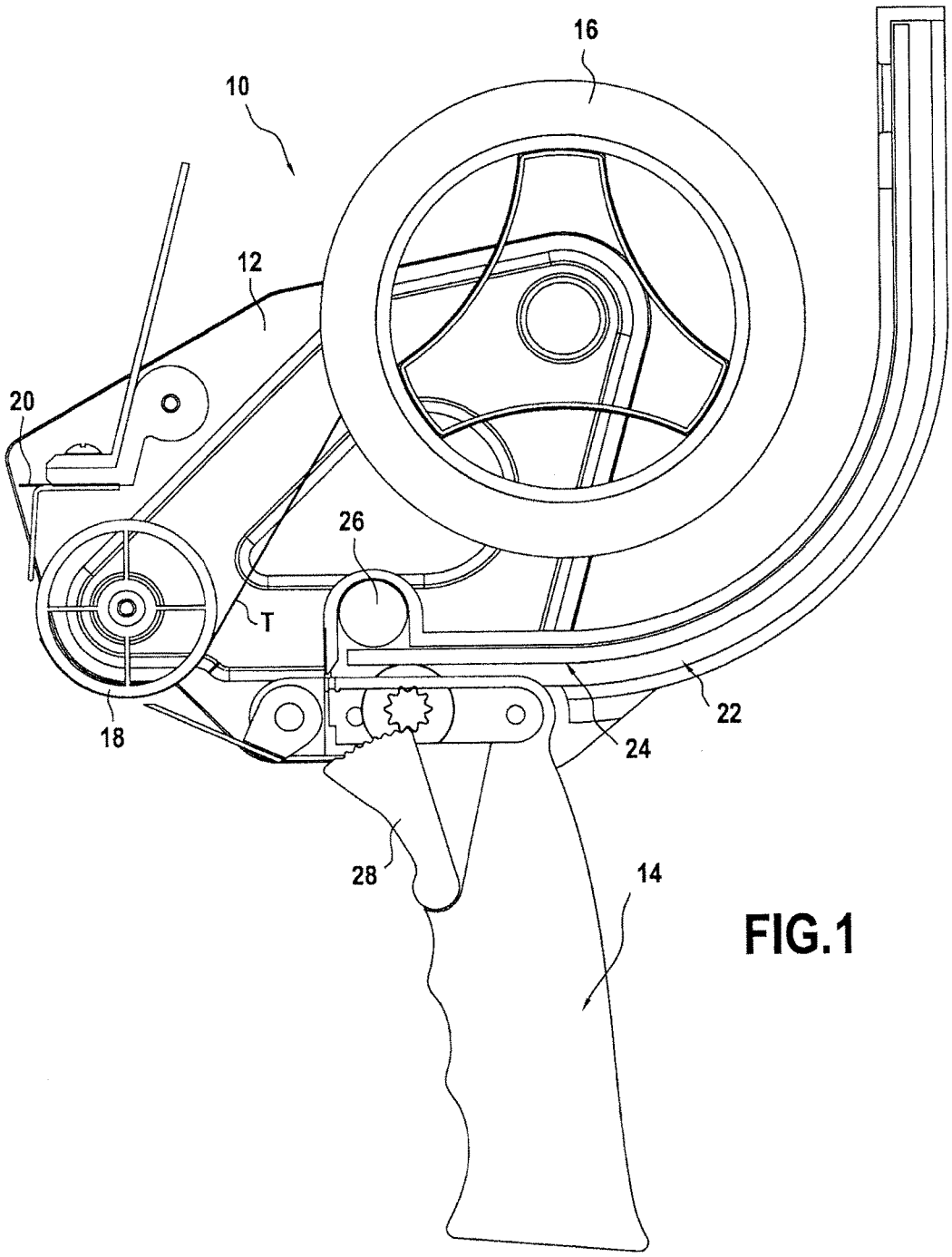
FIG. 1 shows a first embodiment of a hand-held handle dispenser according to the invention in which the insert strip is dispensed from a cartridge of pre-cut insert strips with a trigger or button for initiating the affixing a first pre-cut insert strip.

FIG. 1 illustrates a first embodiment of a hand-held handle dispenser according to the invention.

As a standard hand-held adhesive tape dispenser, the hand-held handle dispenser 10 of the invention essentially comprises a main frame 12 having a handle 14, an adhesive tape roll 16 provided at a rear side of the main frame, an application roller 18 provided at the front side of the main frame and a cutting blade 20. According to the invention, such dispenser further comprises an insert strip cartridge 22 for storing pre-cut insert strips 24, transport/selection rollers 26 for conveying one by one the pre-cut insert strips from the cartridge to the application roller 18 and a trigger 28 for controlling the transport/selection rollers and initiating the affixing of a first pre-cut insert strip. If the length of the first pre-cut insert strip is too short for the handle wanted by the user, then the user can trigger a second pre-cut insert strip to be dispensed just after the previous, and so on to create a very long strip (strap like). This results in the possibility of having different handle lengths (the length however will be a multiple of pre-cut insert strips only) close and tight to the parcel so as not to be torn off (small loop (hand bag) style). Moreover, it can be noted that this solution is less expensive and easier to print advertising.

Preferably, the insert strips can be a thin strip of paper approximately 45 mm×205 mm. The side of the strip, which adheres to the tape, can be printed with some advertising information. This advertising information could be seen through the tape when this one is transparent or partially transparent. Advantageously, the non-printed side of the strip can be coated with a thin film of plastic of same dimensions measuring approximately 45 mm wide so as to improve adhesion to the transport/selection rollers. Another possibility is to use thin films of plastic measuring approximately 45 mm×205 mm instead of paper strips.

The distribution of the insert strips operates as follows. Firstly, the activation of the trigger 28 turns the transport/selection rollers 26 thus advancing an insert strip 24 towards the adhesive surface of the adhesive tape. More particularly, the transport/selection rollers preselect the undermost insert strip from the insert strip cartridge 22, and advance it against the adhesive surface of the adhesive tape. The action of advancing an insert strip towards the adhesive tape results in adhering the insert strip to the adhesive tape and therefore in creating on the adhesive tape of a zone whereby the adhesive tape is no longer capable of adhering to the parcel, thus creating a zone free of adhesive to be used as a "handle". This non-adherent zone also means that the "handle" does not adhere to the user's hand while carrying the parcel.

The user can repeat the process so as to have the insert strips coming one behind the other. This will increase the length of the non-adherent zone thus increasing the "handle" length too. The user can obtain different handle lengths at will.

Figure 2:
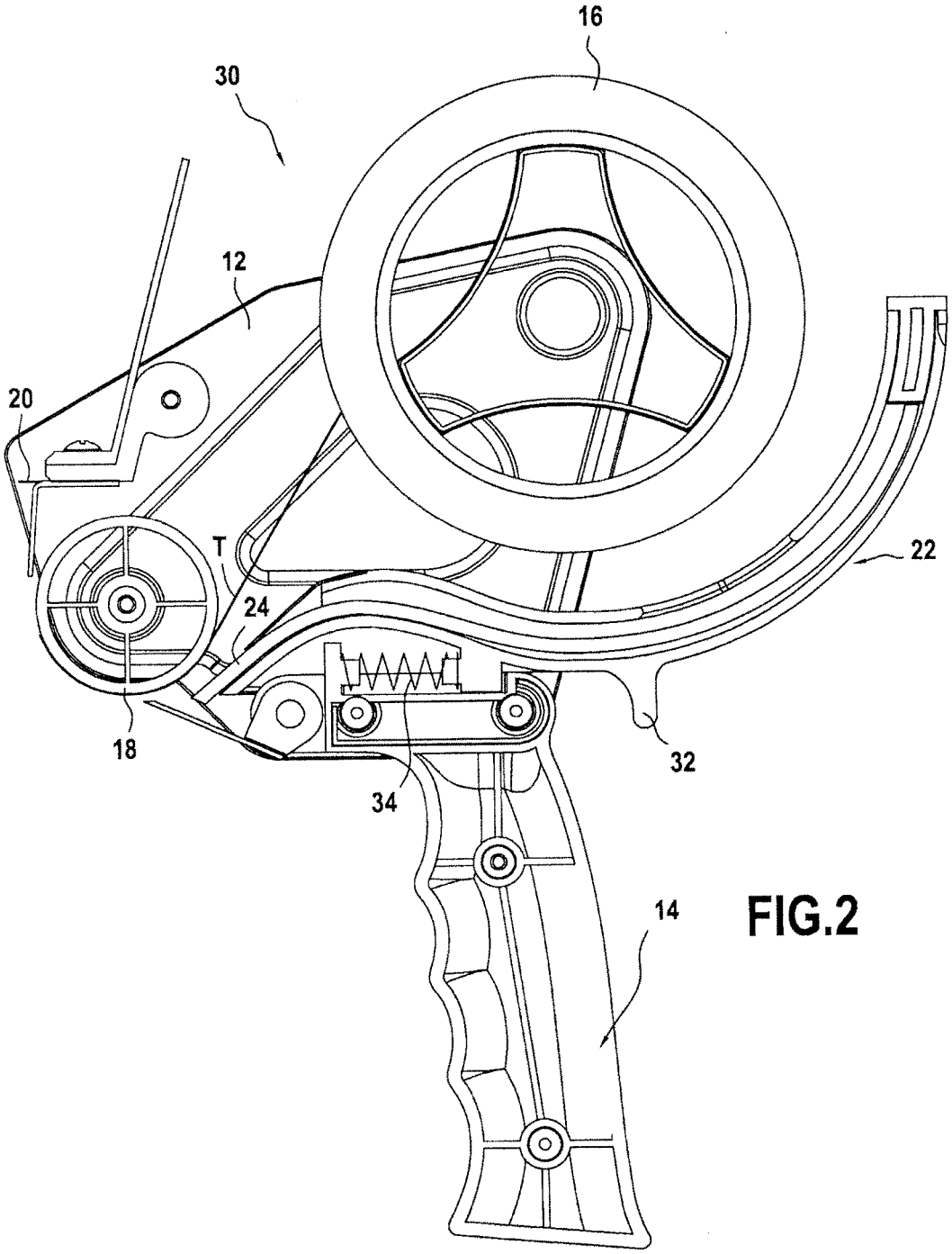
FIG. 2 shows a variant of the first embodiment of FIG. 1 in which the insert strip is dispensed from a cartridge movable between a rest position and a position for affixing a first pre-cut insert strip.

FIG. 2 illustrates a variant of the previous first embodiment of a hand-held handle dispenser. On the figure, the same elements of the dispenser have the same references.

Indeed, rather than triggering an automatic bringing of the pre-cut insert strip in contact with the adhesive surface of the tape, the overall insert strip cartridge can be brought in contact with the adhesive surface of the tape via a sliding action and a spring mechanism. The dispenser 30 comprises as previously a main frame 12 having a handle 14, an adhesive tape roll 16, an application roller 18, a cutting blade 20 and an insert strip cartridge 22 for storing pre-cut insert strips 24. However, neither transport/selection rollers 26 nor trigger 28 are present in this configuration for affixing of a first pre-cut insert strip.

The overall insert strip cartridge 22 can be slid horizontally relative to the main frame (comprising the rest of the dispenser elements). A pusher button 32 allows the user to slide horizontally the insert strip cartridge and thus bring the pre-cut insert strip into contact with the adhesive surface of the adhesive tape. This action brings only the uppermost pre-cut insert strip 24 against the adhesive surface of the adhesive tape, resulting in immediately adhering an insert strip to the adhesive tape.

During this phase when the user pushes on the pusher button to slide horizontally the insert strip cartridge, a spring 34 is compressed. When the user releases the pusher button, the insert strip cartridge slides back to its initial or rest position due to the effect of the spring, thus separating the uppermost pre-cut insert strip, which adheres to the tape, from the others remaining in the insert strip cartridge.

Figure 3:
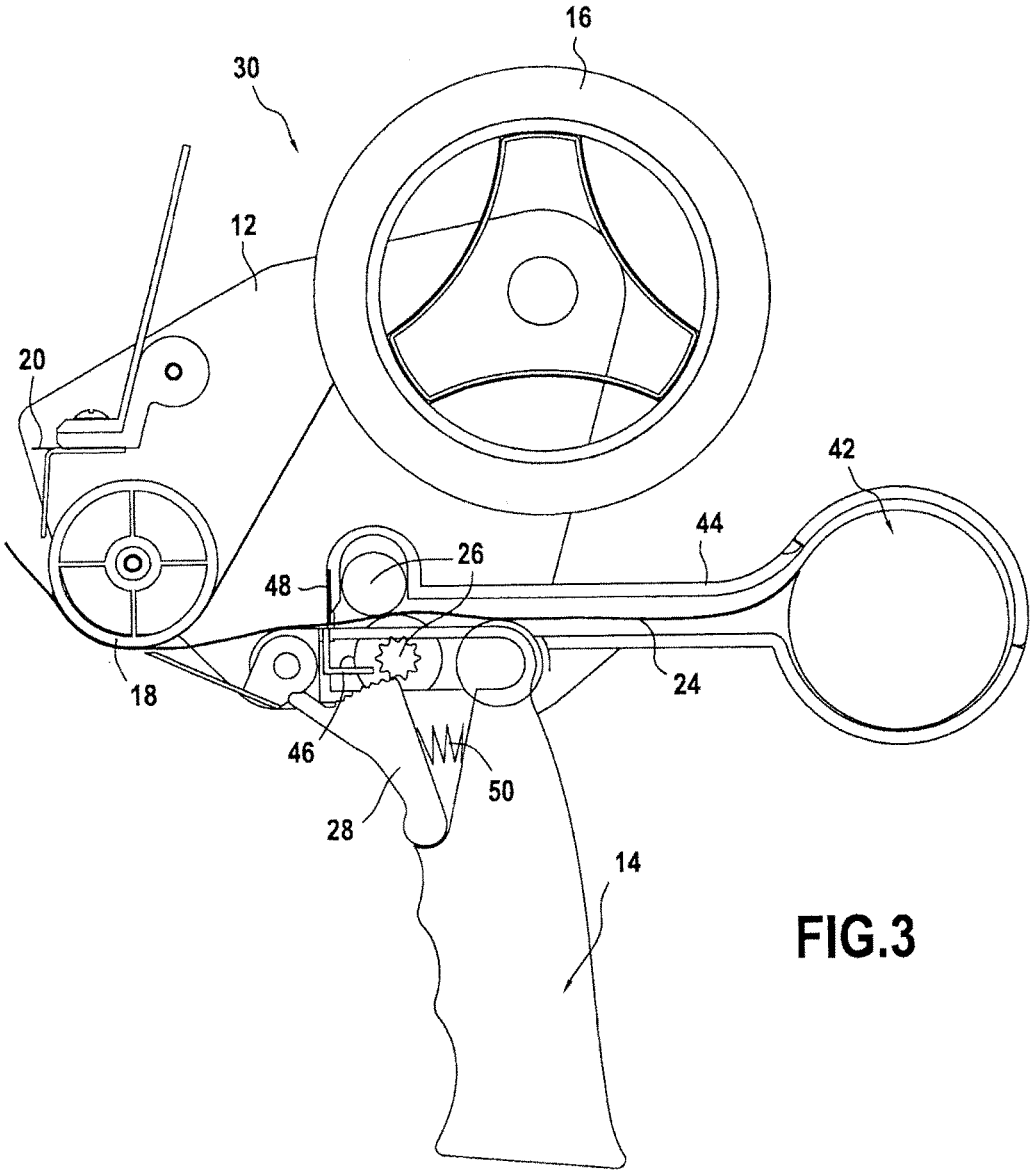
FIG. 3 shows a second embodiment of a hand-held handle dispenser according to the invention in which the insert strip is dispensed from a roll with a trigger for initiating the affixing the insert strip.

FIG. 3 illustrates a second embodiment of a hand-held handle dispenser 40 according to the invention in which the insert strip 24 is dispensed from a roll 42 provided from an insert strip roll cartridge 44 (thus providing a continuous insert strip) with a trigger 28 acting against a spring mechanism 50 for initiating the affixing the insert strip and for stopping the affixing of the insert strip (i.e. cutting the continuous strip from the roll). A presser 46 actionable by the trigger is used to raise the insert strip roll towards a knife 48 in order to cut the insert strip roll. Such a roll permits large reserve for dispensing insert strip of a determined length. More particularly, the user can define the exact length that he wishes for the handle. Preferably, the insert strips can be obtained from a roll of paper measuring approximately 45 mm wide.

In this configuration, the distribution of the insert strips operates as follows. Firstly, the activation of the trigger 28 by the user turns the transport/selection rollers 26 thus advancing the insert strip roll so as to adhere to the adherent surface of the adhesive tape. As the user continues to dispense the tape, the insert strip roll adheres onto the tape and creates a non-adherent zone "handle" equivalent in length to the distance unrolled by the user of the insert strip roll prior to cutting it.

When the adequate length of handle is obtained, the dispensing of insert strip roll needs to be stopped. A further and deliberate action by the user on the trigger 28 forces the presser 46 to rise. This lifts the insert strip roll towards the knife 48, thus resulting in cutting the insert strip roll. Once the insert strip roll is cut, the user can resume affixing the adhesive tape on the parcel to fasten the second side of the handle onto the parcel.

When the user releases the trigger, the trigger automatically returns to its rest position via the spring mechanism 50. During the returning of the trigger to its rest position, the transport/selection rollers 26 are not rotated and the insert strip roll remains in its actual position. The presser returns to its rest down position via a spring mechanism too for example. Thus, the hand-held handle dispenser system is back in the initial stage and a new handle can be initiated by the user at his will.

In a variant of this second embodiment, the insert strip roll includes perforated separating lines. In this case, the cutting mechanism is replaced by a system enabling the tearing of the roll at the user's will. When the user decides to end the non-adhesive zone of the handle, he activates the blockage of dispensing of the insert strip roll. Once the insert strip roll is blocked, the perforated separating line situated between the blocking point and the point of contact with the adhesive tape will be torn by the pulling force resulting from the tape dispensing action.

Preferably, the distance between the perforated separating lines must be equal or slightly less than the distance between the blocking point of the insert strip roll and the point of contact with the adhesive tape with the insert strip roll. Thus, only one perforated separating line shall be positioned between the blocking point of the insert strip roll and the point of contact with the adhesive tape with the insert strip roll. The tearing of the insert trip shall take place in a controlled manner, resulting in a determined handle length.

Figure 4B:
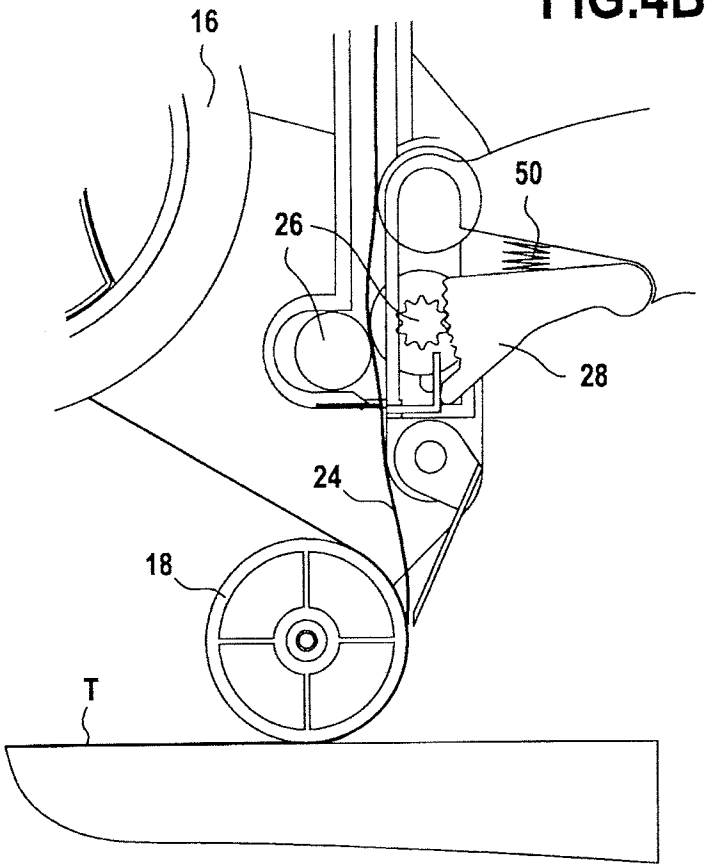
FIGS. 4A to 4E illustrate different tape and strip positions during the operating of the hand-held handle dispenser of the invention.
Figure 4A:
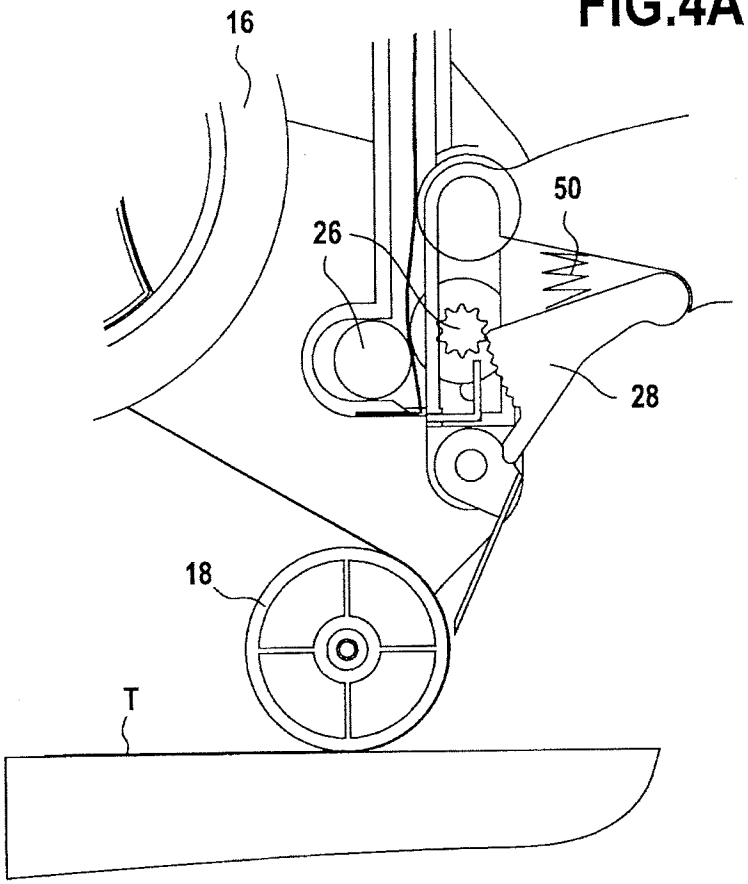
Figure 4D:
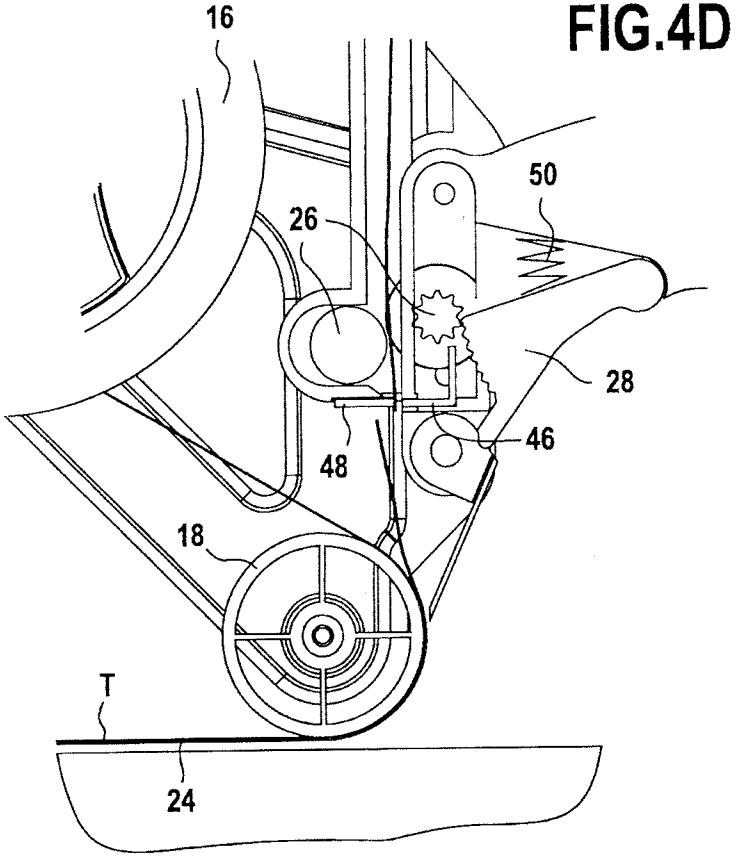
Figure 4C:
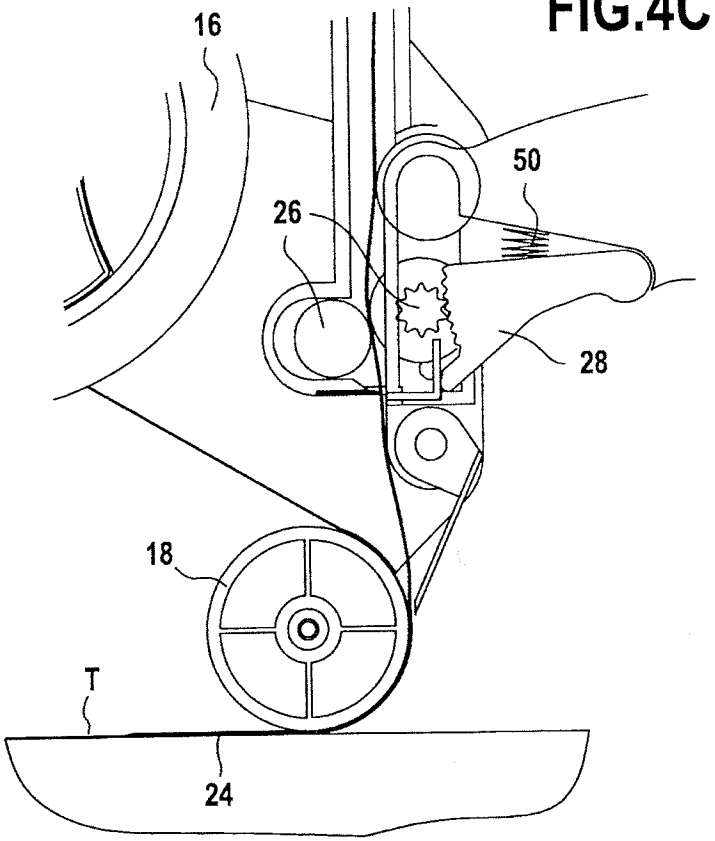
Figure 4E:
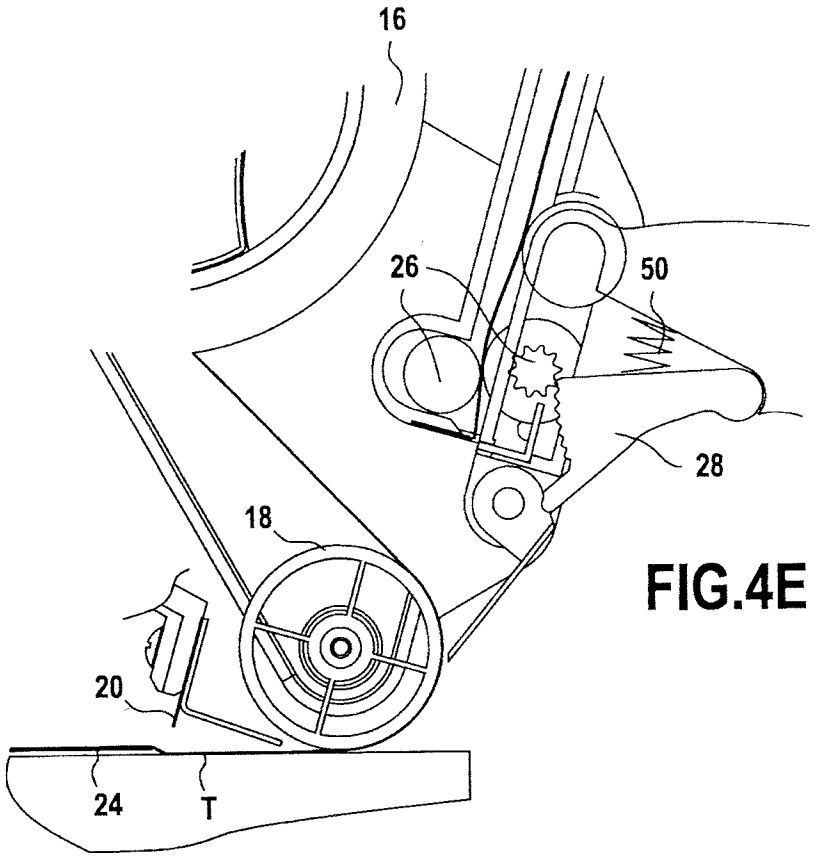

Regardless of the embodiment, the operation for dispensing a handle with the hand-held handle dispenser of the invention can be summarized as follows with reference to FIGS. 4A to 4E:

the parcel must first be closed in a standard way, then the steps for adding the handle takes place with:

- affixing the adhesive tape on the parcel to fasten the first side of the handle onto the parcel, preferably onto the adhesive tape already used for closing the parcel (FIG. 4A),
- dispensing the insert strip at the user's will (FIG. 4B),
- automatically affixing the insert strip onto the adhesive tape by bringing the insert strip in contact with the adhesive surface of the tape (FIG. 4C),
- stopping the affixing (FIG. 4D), and
- resuming the affixing the adhesive tape on the parcel to fasten the second side of the handle onto the parcel, preferably onto the adhesive tape already used for closing the parcel (FIG. 4E).

Depending on the embodiment, stopping the dispensing and affixing of the insert strip roll is made by tearing the insert strip roll via the presser 46 blocking the insert strip roll or by cutting the insert strip roll via acting on the knife 48.

It is recommended that the non-adhering part of the handle be preceded and terminated by a length of adhesive tape measuring at least 15 cm, and adhering to both opposite sides of the parcel. The non-adhering part of the handle should start on the top edge of the parcel and should reach the opposite edge of the parcel. Furthermore, for better resistance, it is recommended that the adhesive parts of the handle adhere onto the adhesive tape already used for closing the parcel.

Large parcels may require more than one handle. Two handles can be placed on either side of the parcel and perpendicular to the longest edge. This enables the parcel to be carried by one or two persons depending on its size and weight.

It must be noted that the different elements for dispensing the insert strip or insert strip roll can be provided as handle distributor kits for upgrading standard adhesive tape dispensers in the field or for producing brand new combo tape and handle dispensers, and benefiting from the experience curve and economies of scale of current adhesive tape dispenser. Alternatively, the handle distributor can be integrated onto adhesive tape dispenser currently distributed on the market place allowing the following possibilities such as integrating the handle distributor within the production line of adhesive tape dispenser.

The invention claimed is:

1. A hand-held handle dispenser comprising: a hand-held main frame having a handle, an adhesive tape roll provided at a rear side of the main frame for delivering an adhesive tape, an application roller provided at a front side of the main frame for applying the adhesive tape on a parcel and a cutting blade for cutting the adhesive tape, wherein the hand-held handle dispenser further comprises a cartridge for storing at least one insert strip and transport and affixing means for conveying said at least one insert strip from said cartridge to said application roller and affixing said at least one insert strip against the adhesive tape at the application roller, the adhesive tape extending from a side of the parcel to an opposite side of the parcel such that two opposing ends of the adhesive tape attach to the side and the opposite side of the parcel, and wherein the remaining part of the adhesive tape between the attached side and the opposite side of the parcel in contact with the at least one insert strip forms a handle for carrying the parcel.

2. The hand-held handle dispenser according to claim 1, wherein the cartridge is arranged to store pre-cut insert strips and in that said transport and affixing means comprises transport/selection rollers for conveying one by one the pre-cut insert strips from the cartridge to said application roller and a trigger for controlling said transport/selection rollers and initiating the affixing of a first pre-cut insert strip.

3. The hand-held handle dispenser according to claim 2, wherein, in order to create a long strip corresponding to a particular handle length, a second and further pre-cut insert strips are dispensed after the first one between where the two opposing ends of the adhesive tape attach to the side and the opposite side of the parcel.

4. The hand-held handle dispenser according to claim 1, wherein the cartridge is arranged to store pre-cut insert strips and in that said transport and affixing means comprises a pusher button actionable by a user to slide the cartridge horizontally relative to the main frame in order to bring an uppermost pre-cut insert strip against the adhesive tape and a spring to slide back the cartridge to its rest position when the user releases the pusher button, thus separating the uppermost pre-cut insert strip from the other remaining in the cartridge.

5. The hand-held handle dispenser according to claim 2 or claim 4, wherein each pre-cut insert strip is formed by a strip of paper approximately 45 mm×205 mm with a non-printed side coated by a film of plastic of same dimensions.

6. The hand-held handle dispenser according to claim 1, wherein the cartridge is arranged to store an insert strip roll and in that said transport and affixing means comprise a trigger acting against a spring mechanism for initiating the affixing of the insert strip and for stopping the dispensing from said insert strip roll by cutting the insert strip.

7. The hand-held handle dispenser according to claim 6, wherein the cutting of an insert strip of a determined length is performed via a presser acting on a knife for stopping the dispensing from said insert strip roll.

8. The hand-held handle dispenser according to claim 6, wherein said insert strip roll includes perforated separating lines, which are regularly spaced along the insert strip of the roll at a distance that is equal or less than the distance between a blocking point for the dispensing from the insert strip roll and a point of contact of said insert strip roll with the adhesive tape.

9. The hand-held handle dispenser according to claim 8, wherein the cutting of an insert strip of a determined length is performed via a presser blocking the dispensing of said insert strip roll.

10. A method for dispensing a handle with a hand-held handle dispenser comprising a hand-held main frame having a handle, an adhesive tape roll provided at a rear side of the main frame for delivering an adhesive tape, an application roller provided at a front side of the main frame for applying the adhesive tape on a parcel and a cutting blade for cutting the adhesive tape, wherein the hand-held handle dispenser further comprises a cartridge for storing at least one insert strip and transport and affixing means for conveying said at least one insert strip from said cartridge to said application roller and affixing said at least one insert strip against the adhesive tape from a side of the parcel to an opposite side of the parcel such that two opposing ends of the adhesive tape attach to the side and the opposite side of the parcel, and wherein the remaining part of the adhesive tape between the attached side and the opposite side of the parcel in contact with the at least one insert strip form a handle for carrying the parcel, the method comprising the following steps:

closing the parcel with a first adhesive tape, affixing a second adhesive tape onto the parcel to fasten a first side of the handle onto the parcel, dispensing at least one first insert strip, automatically affixing said at least one first insert strip onto said second adhesive tape by bringing said at least one first insert strip in contact with said second adhesive tape at the application roller, stopping the dispensing and affixing of said at least one first insert strip, and resuming the affixing of said second adhesive tape onto the parcel to fasten a second side of said handle onto the parcel.

11. The method according to claim 10, wherein the cartridge is arranged to store an insert strip roll, further comprising stopping the affixing of at least one first insert strip dispensed from said insert strip roll by cutting said insert strip roll via a presser blocking or acting on a knife for stopping the dispensing of said insert strip roll.

12. The method according to claim 11, wherein the affixing of said second adhesive tape on the parcel is made onto a determined length of said first adhesive tape already used for closing the parcel.

13. The method according to claim 10, wherein the affixing of said second adhesive tape on the parcel is made onto a determined length of said first adhesive tape already used for closing the parcel.

14. A portable hand-held handle dispenser comprising:

a hand-held portable main frame having:

a front side;

a rear side;

a handle graspable by a hand of a user, the portable hand-held handle dispenser manually moveable by the user during operation;

a tape roll holder to hold an adhesive tape roll, the tape holder provided at the rear side of the main frame to deliver an adhesive tape;

a cartridge to hold insert material;

an application roller provided at the front side of the main frame, positioned to simultaneously engage the adhesive tape dispensed from the adhesive tape roll held by the tape roll holder and the insert material dispensed from the cartridge as the insert material contacts the adhesive tape and as the adhesive tape is manually applied on a parcel;

a cutting blade positioned relatively downstream of the application roller in a direction in which the adhesive tape is dispensed, to cut the adhesive tape dispensed from the adhesive tape roll held by the tape roll holder as the adhesive tape is manually applied on the parcel; and a single trigger or button positioned with respect to the handle to be selectively manually movable by a digit of the hand of the user while holding the handle with the hand and applying the adhesive tape to a parcel, and a total length of the insert material provided from the cartridge to the application roller to thereby affix the insert material against the adhesive tape to form a handle for the parcel set via the single trigger or button, the handle spaced inwardly from a first end of the adhesive tape attached to one side of the parcel and spaced inwardly from a second end the adhesive tape attached to an opposite side of the parcel, such that the first and second ends of the adhesive tape attach to the side and the opposite side of the parcel, wherein the remaining part of the adhesive tape between the attached side and the opposite side of the parcel are in contact with the insert material and forms the handle for the parcel.

15. The portable hand-held handle dispenser according to claim 14, further comprising a number of transport/selection rollers physically coupled to be rotated via movement of the trigger, the transport/selection rollers positioned to engage and convey the insert material toward the application roller in response to a rotation of the transport/selection roller in response to a movement of the trigger.

16. The portable hand-held handle dispenser according to claim 15, wherein the insert material comprises a plurality of pre-cut insert strips, and each time the trigger is depressed, a leading one of the pre-cut insert strips is moved into contact with the adhesive tape at the application roller, and affixes the leading one of the pre-cut insert strips to the adhesive tape.

17. The portable hand-held handle dispenser according to claim 15, wherein the insert material comprises an insert strip roll, and further comprising a presser and a knife, the presser coupled to move in response to a first movement of the trigger to a first position in which the presser moves a leading end of the insert strip roll into contact with the adhesive tape at the application roller, and affix the leading end of the insert strip roll to the adhesive tape, and to move in response to a second movement of the trigger to a second position in which the presser moves the insert strip role into cutting engagement with the knife to cut the insert strip roll.

18. The portable hand-held handle dispenser according to claim 17, further comprising a spring that biases the trigger toward a disengaged position away from the first and the second positions.

19. The portable hand-held handle dispenser according to claim 14, wherein the insert material comprises a plurality of pre-cut insert strips and movement of the single button moves the cartridge in to an engaged position relative to the application roller to place a leading one of the pre-cut insert strips into contact with the adhesive tape at the application roller, and affixes the leading one of the pre-cut insert strips to the adhesive tape.

20. The portable hand-held handle dispenser according to claim 19, further comprising a spring that biases the cartridge to a disengaged position relative to the application roller, opposite the engaged position.

* * * * *